US005477952A

United States Patent [19]

Castellano et al.

[11] Patent Number: 5,477,952

[45] Date of Patent: Dec. 26, 1995

[54] RETROFITTABLE UNIVERSAL SECURE ACTIVITY-REPORTING ELECTRONIC COIN TRACKER FOR COIN-OPERATED MACHINES, PARTICULARLY FOR DETECTING EMBEZZLEMENT OF MONIES COLLECTED BY VIDEO GAMES

[75] Inventors: Mark R. Castellano, La Jolla; Lawrence M. Hermansen; Alexander R. McKay, Jr., both of San Diego, all of Calif.

[73] Assignee: Compuline, Inc., San Diego, Calif.

[21] Appl. No.: 29,441

[22] Filed: Mar. 11, 1993

[51] Int. Cl.[6] ..... G07F 9/02

[52] U.S. Cl. ..... 194/200; 194/217; 340/825.16

[58] Field of Search ..... 194/200, 201, 194/202, 217, 218; 364/479; 340/825.16, 825.33, 825.35

[56] References Cited

U.S. PATENT DOCUMENTS 3,927,688 12/1975 Cohn et al. .
4,216,461 8/1980 Werth et al. ..... 340/149 R
4,280,181 7/1981 Levasseur ..... 364/464
4,369,442 1/1983 Werth et al. ..... 340/825.35
4,392,564 7/1983 Hayashi .
4,520,451 5/1985 McLaughlin ..... 364/900
4,689,757 8/1987 Downing ..... 364/550
4,907,250 3/1990 Ricks ..... 377/7
4,976,346 12/1990 Juds et al. ..... 194/200
5,036,966 8/1991 Kaspar et al. ..... 194/217
5,051,564 9/1991 Schmidt ..... 235/381

*Primary Examiner*—F. J. Bartuska
*Attorney, Agent, or Firm*—William C. Fuess

[57] ABSTRACT

An electronic coin tracker for coin-operated machines, particularly video games, is retrofittable to most such coin-operated machines as produce an electrical signal upon the deposit of coins. The coin tracker is physically and electronically secure in its function to monitor both (i) the deposit of coins and (ii) the activity of the coin operated machine (whether such activity is responsive to, or only to, the deposit of coins or not). The coin tracker reports the monitored (i) coin deposits and (ii) machine activity electronically, preferably through an infrared light data link. The reported data may readily be analyzed to determine whether or not the machine operation and/or machine receipts have been subject to fraud or embezzlement.

23 Claims, 7 Drawing Sheets

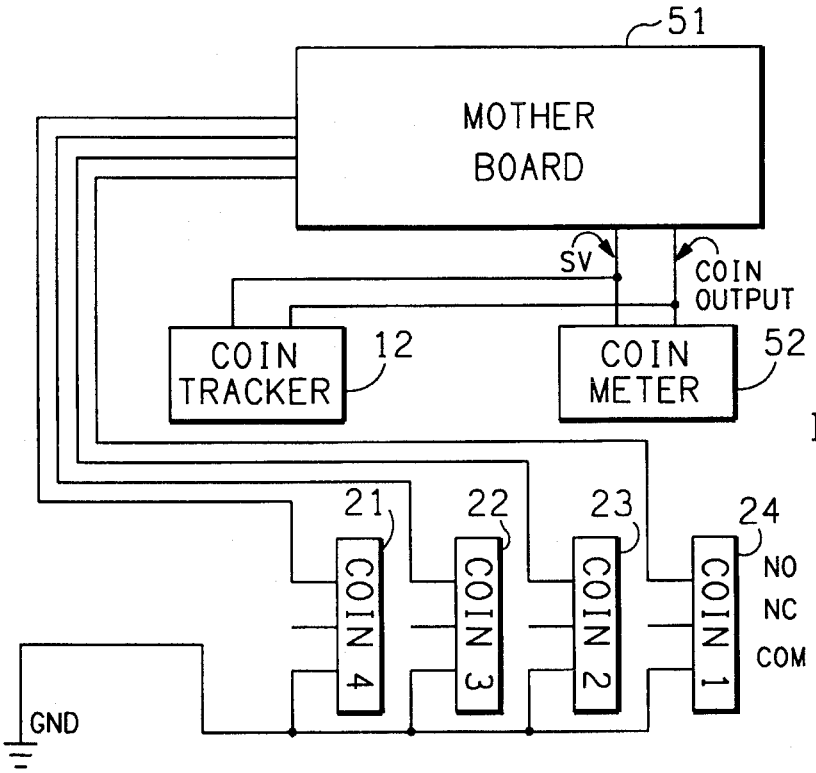

FIG. 3

FIG. 4A

U3 114

| |
|---|
| COIN TRACKER SERIAL NUMBER |
| POWER DOWNS, OR POWER INTERRUPTION COUNT |
| CURRENT COIN METER #1 (RESETTABLE ELECTRONIC COIN COUNTER #1) |
| CURRENT COIN METER #2 (RESETTABLE ELECTRONIC COIN COUNTER #2) |
| CURRENT COIN METER #3 (RESETTABLE ELECTRONIC COIN COUNTER #3) |
| CURRENT COIN METER #4 (RESETTABLE ELECTRONIC COIN COUNTER #4) |
| PREVIOUS COIN METER #1 (RESETTABLE TOTAL COIN COUNTER #1) |
| PREVIOUS COIN METER #2 (RESETTABLE TOTAL COIN COUNTER #2) |
| PREVIOUS COIN METER #3 (UNRESETTABLE TOTAL COIN COUNTER #3) |
| PREVIOUS COIN METER #4 (UNRESETTABLE TOTAL COIN COUNTER #4) |
| SPARE METER (SPARE REGISTER) |
| TIME ON |
| TAMPERING CODES, INCLUDING DISCONNECTS AND /OR SHORTS |

EEPROM

VCC
R1 100K
D2
Q7
115
R2 1K
R20 4.7K
113
Q1
117
U2
OUT
DIS
CON
TRIC
THRES
RST
R3 36K
R14 100K
C2 470uF
C1 .01uF
C11 15uF
Y1 4.0KHz
C10 15uF
11
Z9
COIN1 OUT
COIN2 OUT
COIN3 OUT
COIN4 OUT
GROUND
EMITTER CON
REF.
51
Z8
PA05
R22 100K
R21 100K
R7 100K
R7 100K
Q5
Q4
Q3
Q2
R20
R19
R17
R18
U1
RCLR
OSC1
OSC2
RC7
RC6
RC5
RC4
RC3
RC2
RC1
RC0
RD7
RD6
RD5
RTCC
VDD
VSS
RA0
RA1
RA2
RA3
RB0
RB1
RB2
RB3
RB4
111
U3
D1
SK
CS
D0
114

FROM FIG. 4-1
FROM FIG. 4-1

FIG.5
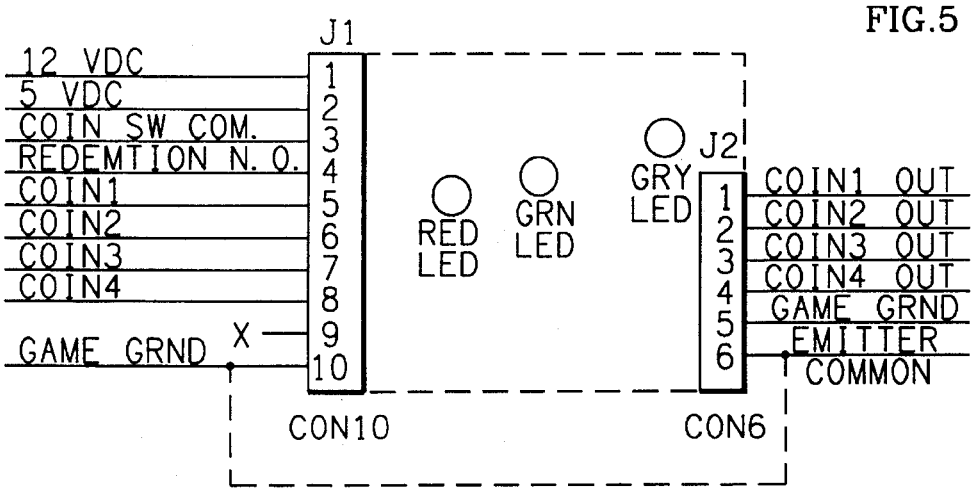
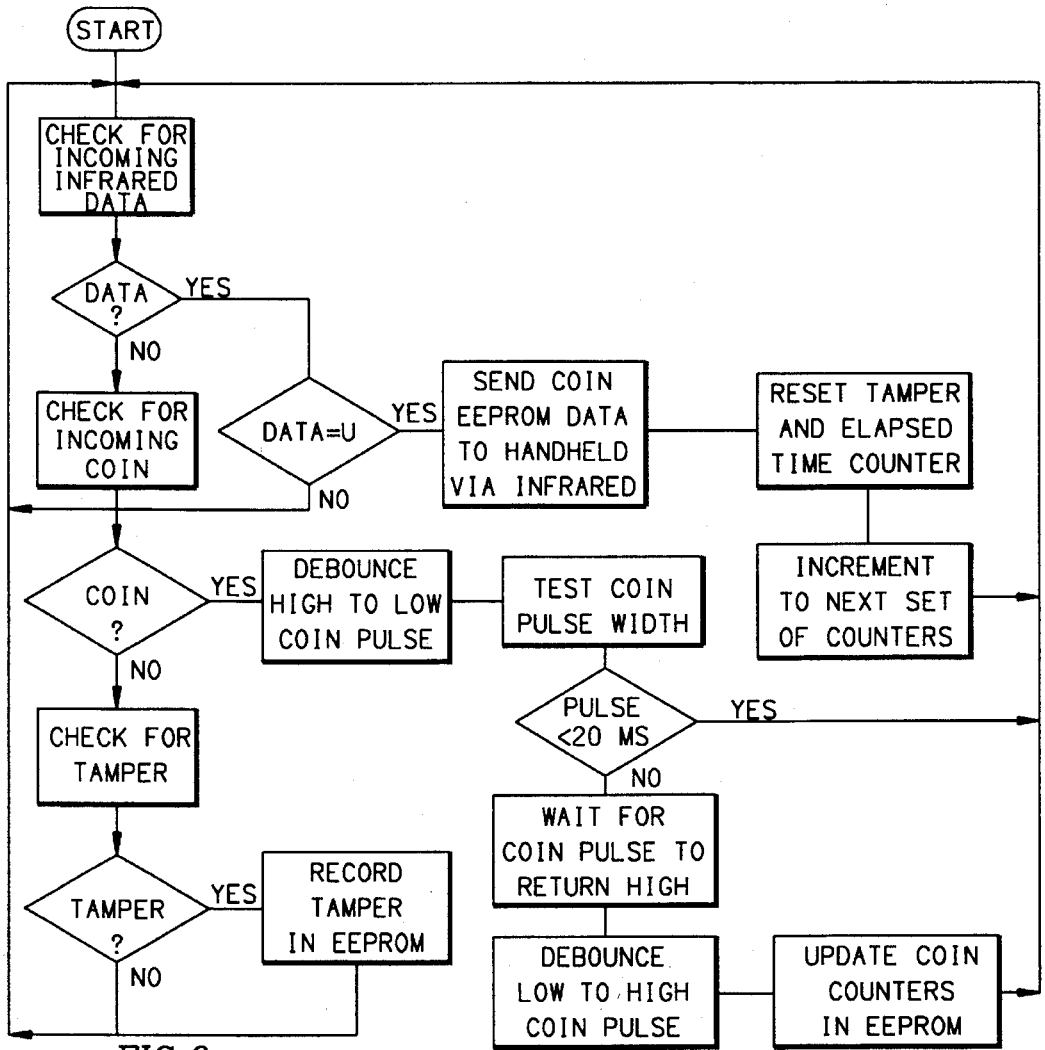
FIG.6

RETROFITTABLE UNIVERSAL SECURE ACTIVITY-REPORTING ELECTRONIC COIN TRACKER FOR COIN-OPERATED MACHINES, PARTICULARLY FOR DETECTING EMBEZZLEMENT OF MONIES COLLECTED BY VIDEO GAMES

BACKGROUND OF THE INVENTION

1. Field of the Invention

The present invention generally concerns secure monitoring systems for coin-operated machines. The present invention particularly concerns physically and electrically secure electronic systems for monitoring and reporting the coin receipts and the usage activity of a coin-operated electronic machine such as, for example, a video game.

2. Description of the Prior Art 2.1 The Problem of The Embezzlement of Proceeds From Certain Coin-Operated Machines Coin-operated machines are ubiquitous in modern American life circa 1993. Because of societal demand for convenience items, information, entertainment, and other goods and services suitably dispensed or administered by machines, and because of the high cost of using human labor to collect small, coin-denominated, fees, coin-operated machines have proliferated into diverse areas and functions. Nonetheless to the diversity of function performed, most coin-operated machines are highly evolved, and considerably sophisticated, in their performance of such functions. This is simply to say that, from the lowly newspaper vending machine to the sophisticated slot machine, coin-operated machines generally work quite well, and reliably, for their users. High performance has led to high expectations. American consumer tolerance for coin-operated machine malfunctions, especially such malfunctions as might involve any consumer loss of monies, is low. Coin-operated machines are seldom given a "second chance" to perform, and are generally shunned after the slightest incipient malfunction.

Coin-operated machines are typically reasonably protected against causal user theft or fraud. The coin boxes of the machines typically have physical locks of quality as reasonably suits the amounts of money protected. Coin-accepting mechanisms typically have slug rejecters, such as those of the magnetic and optical types, to reject undesirable coins, slugs and bills.

Most coin-operated machines are not, however, protected against fraudulent manipulations and/or embezzlements by persons who have access—either authorized or unauthorized—to the interior of the machine. Normally the only persons having legitimate access to the interior of the machine are owner/supplier of the machine, or his legitimate agents. The typical recourse of the owner/supplier of a coin-operated machine whose machine is being robbed of goods, services and/or money is to increase or alter the security of that machine which is being violated—for example, to change the locks—or to relocate the machine.

Sometimes the economic inducement to rob coin-operated machines is so great as to induce fraud or embezzlement. By their very nature coin-operated machines typically dispense the same or highly similar goods or services only in moderate sized, and often repetitive, streams typically having only modest value per unit time. Accordingly, major fraud or embezzlement directed against coin-operated machines and machine owners necessarily involves theft of the money proceeds of the machines.

Fraudulent misappropriation, or theft, or embezzlement of the monies collected by vending machines that dispense goods is generally readily detectable as an inconsistency between the goods sold and the monies collected. However, coin-operated machines that dispense entertainment, or indeterminate amounts of goods, are opposite. These machines may be subjected to undetectable thefts of their services, or embezzlements of their collected (coin) proceeds.

Foremost among the coin-operated machines receiving significant amounts of money in return for dispensing indeterminate amounts of goods and/or services are slot machines. Slot machines normally have significant physical security so as to prevent both the theft of their services (an opportunity to win a gambling prize) such as by a defeat of their coin reception mechanisms, or theft of the money proceeds within the machines. Many slot machines are located on the premises of the owner/controllers of the machines, and may not be effectively emptied of monies save by authorized personnel performing normal collections. Nonetheless to their excellent physical security, the money receipts, and play action, of high payout slot machines may be monitored in real time by automated electrical and electronic systems. The machine status is sometimes continuously reported to a "teller cage", or "back room", where machine use and play action may be monitored for purposes of promotion and payout as well as security.

Another type of coin-operated machine receiving significant amounts of money in return for dispensing indeterminate amounts of goods and/or services is a video game machine, such as is located in a video arcade. The current, circa 1993, total size of the video game industry in the United States is $7.5 billion per year, or larger than the motion picture industry. Many individual video game machines receive (generally in coin) proceeds in excess of $100 per day, and as many as one hundred (100) or more machines may typically be located in a single arcade, or gaming hall.

A particularly difficult security problems is presented to the owner/operator of the video game in that (i) he/she does not normally own or control the premises where the game is located, (ii) the game typically accumulates significant amounts of money between collections, (iii) the physical security of the game may be subject to defeat, especially as the game is outside of its owner's control for extended time periods, and (iv) the internal security of the game (to such extent as such even exists) may likewise be subject to defeat. To such extent as the owner/operator of the video game cannot accurately tell the number of games played (as an indication of expected money receipts), and/or is deceived into believing that the game has incurred less usage, and has collected less monies, than is in actual fact the case, then the owner/operator may be defrauded of revenues that are properly due him/her.

A video game is typically located in an arcade containing many dozens, or hundreds, of such games. The arcade owner/operator is usually not the same entity as the owner/operator of some, or all, of the video games located in the arcade. The arcade owner may require access to the interiors of all games for the correction of minor problems such as coin jams, and/or the unloading of collected coins so that the coins may be given to players in exchange for paper money in a continuous cycle. For such rare games as the arcade owner/operator does not have authorized access much time is available to for a dishonest owner/operator to surreptitiously defeat the locks of a video game.

The rental of the video game by the arcade owner/operator is often based on a percentage of the collections of the machine, for example 50%—50%. The owner of the machine verifies machine activity through a simple coin counter. This coin counter is subject to selective disconnection, rollback, and all sorts of mechanical and electrical manipulations to defeat or to alter the accuracy of its count. It is thus a relatively simple matter for a dishonest arcade owner who wishes to fraudulently appropriate 100%, instead of his/her proper share, of a portion of the proceeds of a video game to adjust or defeat the counter of the game in direct correspondence to the amount of monies embezzled from the game, and from the game's owner/supplier.

The present invention will bee seen to deal with the monitoring, accounting, and reporting of the (i) activities, and (ii) receipts of a coin-operated machine, normally a video game, in a manner that is not readily susceptible of being either defeated or circumvented in order to misappropriate either the (i) services or (ii) the coin proceeds of the machine.

2.2 Previous Reporting by Coin-Operated Machines Over Electronic Communications Links It is known that coin-operated machines may report their activity over electronic communications links, including infrared light communications links.

2.2.1 Previous Electronic Newspaper Racks Reporting Sales Activity

The TK-Electronic™ (trademark of Kaspar Wire Works, 1127 Sho-Rack Drive, Box 1127, Shiner, Tex. 77984) coin mechanism of Kaspar Wire Works, 1127 Sho-Rack Drive, Box 1127, Shiner, Tex. 77984 is retrofittable to all TK newspaper racks to collect, store, and, via a Sho-Rack Scanner™ (trademark of Kaspar Wire Works) transfer sales data from the newspaper rack to a central sales outlet.

An electronic circuit within the newspaper rack accumulates information regarding the times and amounts of all sales. A "scanner" communicating by infrared light is held proximately to a newspaper rack in order to unlock the paper door, set an internal clock of the rack, and set the sales price. The electronic circuit reports the total amount of sales, the total cash collected, the last two sales prior to audit, the rack load time, the time of first sale, the sales in each of twelve programmable time slots, draws, returns, and audit time. The sales information collected daily is taken, and downloaded, into a computer. Software operative in the computer helps to formulate daily sales reports, rack locations and maintenance reports, full reports on draws and returns, reports on the times and locations of sales, cash control reports, and route reports.

2.2.2 Proposed Electronic Parking Meters

It has been proposed in a 1993 projected "EMM" product offering of Duncan Industries, Parking Control Systems, P. O. Box 849, 340 Industrial Park Road, Harrison, Ark. 72601, U.S.A., that an Electronic-Mechanical Mechanism ("EMM") for a parking meter should monitor, and electronically report, coin-handling activity.

According to Duncan Industries, each electronic mechanical mechanism ("EMM") is proposed to be equipped with an Infrared (IRED) communications port. This port shall be capable of sending and receiving data to an authorized hand held terminal. The communications port shall be activated only by an authorized hand held data terminal device and shall ignore any other signal or device. The communication shall ignore any other signal or device. The communication port shall be capable of performing the following activities: Retrieval and/or Reprogramming of Time and Rate Structure/Downloading of Audit Information (including Meter Serial Number and Total Value of Coins Accepted since last audit); Retrieval of Meter Serial Number for Maintenance and/or Inventory Functions. These communications functions shall be performed reliably under normal street conditions without the necessity of opening the housing or physically connecting to the electronic mechanical mechanism so long as the face of the mechanism is visible and legible through the housing window of the meter housing. The communications protocol shall be so designed such that only the appropriate coded signal from an authorized hand held data terminal shall enable and activate the communications functions.

The hand held data terminal device shall be equipped with an Infrared (IRED) device designed specifically for the purpose of remote communication with the electronic mechanical mechanism. The hand held data terminal device shall develop and store data internally through communications with: a personal computer (PC), electronic mechanical mechanism, and a self-contained keyboard for manual data input. When the terminal is downloaded to a personal computer it shall be possible to import the resulting files directly into a data base software system to derive various reports including Audit, Maintenance, Inventory, and Rate Structure Management.

2.3 The Function of the Coin Tracker of the Present Invention to Deal With Fraud and Embezzlement, and the Distinctions of a Coin-Tracking Device and a Reporting System So Functioning The coin tracker mechanism of the present invention will be seen to be distinguished from such previous auditing and coin-receipts reporting systems in that both (i) the delivery of goods and/or services by the machine, and (ii) the coin receipts of the machine, are monitored and reported. Indeed, it should be considered that, when the coin tracker mechanism of the present invention is used to monitor and report on coin-operated video game machines (as is its primary intended function) then the goods and/or services provided by such a video game machine is: the service of playing a video game. The historical record of the provision(s) of this service, once the service has been provided, are notoriously easy to defeat in existing video games, as explained above. Accordingly, the independent record of the provision of services by a video game machine (the number of times that the game is played) that will be seen to be provided by the mechanism of the present invention will be recognized to be in the nature of an anti-fraud device and system, and not simply a reporting or auditing system.

Compare, for example, the existing and projected mechanisms discussed above for monitoring and reporting on each of (i) newspaper machines, and (ii) parking meters. For a (i) newspaper machine the monitoring of the provision of goods and/or services by the machine—the providing of a newspaper—is essentially irrelevant. The supplier of the machine knows how many newspapers were loaded into the machine, and the coin receipts of the machine (whether monitored and reported by an automated system, or not). Accordingly, if the monies received do not match the goods (newspapers) delivered then there is theft against the machine of either (i) money and/or (ii) goods (newspapers). (It usually matters little to the supplier of the machine as to which of these occurrences is actually transpiring—the net effect on the supplier's revenues being the same. The supplier usually either increases the physical security of the machine or moves it to a more secure location.) Accordingly, no separate mechanism—like as to that of the present invention—is necessary to detect fraud against newspaper machines or any machines delivering goods.

The monitoring and reporting of a (ii) parking meter is a different story. The parking meter delivers a service: an authorization to park legally for such a period of time as is purchased from the meter. This service is subject to theft, and the coin proceeds of this service are also subject to theft. However, just as with a video game, the theft of services relative to the difficulty, and the risk of detection and apprehension for theft, involved usually precludes that the user(s) of the machine are significant thieves of the machine's services. Unlike a video game, however, a parking meter must generally be robbed of its coin proceeds in public. A large number of meters must be robbed relatively frequently to equal the amounts of funds that may be fraudulently embezzled from video games. Finally, it is difficult to "skim" the proceeds of parking meters because the required high number of unauthorized accesses for purposes of theft promotes detection, and arrest. A parking meter that is simply emptied of proceeds is usually detectable when normal collection personnel arrive some period of time after a previous routine collection, but only momentarily after a theft. Accordingly, and although anti-fraud monitoring of parking meters might be useful (especially as involves fraud by authorized collection personnel), there are, to the best knowledge of the inventors, no such anti-fraud devices or systems for parking meters or other service-providing coin-operated machines.

The coin tracker mechanism of the present invention will be seen to be distinguished from previous auditing and coin-receipts reporting systems in that its monitoring and reporting of (i) the delivery of goods and/or services by the machine, and (ii) the coin receipts of the machine, is both physically and electrically secure. The security of the coin tracker mechanism will be seen to be a function of (i) its electrical location, and connection, within the coin-operated machine, and (ii) its own, internal, physical and electrical security features. Although no security is absolute, and the mechanism of the present invention might be expected to be susceptible of being defeated by the considerable resources of, for example, the intelligence agency of a major government, the mechanism will be seen to be very difficult of being defeated, or circumvented, by such petty thieves and embezzlers as have previously robbed video game machines.

SUMMARY OF THE INVENTION

The present invention contemplates an electronic coin tracker for coin-operated machines, particularly video games. The present invention also contemplates a tamper resistant coin-operated machine.

Each of several embodiments of coin trackers in accordance with the present invention is of a universal type that may be retrofitted to most such coin-operated machines as produce an electrical signal upon the deposit of coins. The coin tracker is physically and electronically secure in its function to monitor both (i) the deposit of coins and (ii) the activity of the coin operated machine (whether such activity is responsive to, or only to, the deposit of coins or not). The coin tracker reports the monitored (i) coin deposits and (ii) machine activity electronically, preferably through an infrared light data link. The reported data may readily be analyzed to determine whether or not the machine operation has been subject to fraud or abuse.

In one of its embodiments an electronic coin tracker device in accordance with the present invention is used with an electrical coin-operated machine having (i) a coin-receiving mechanism for producing a coin-received electrical signal upon the receipt of a coin, and (ii) a machine controller for enabling a machine function in response to receipt of the coin-received electrical signal. The coin tracker device includes a receiver that receives the coin-received electrical signal from the coin-receiving mechanism; a coin counter that counts the number of times that the coin-received electrical signal is received in order to maintain a current coin-count representing the number of coins received into the coin-receiving mechanism; and a transmitter that further communicates the coin-received electrical signal, after each receipt thereof is counted by the coin counter means, to the machine controller in order that the machine function is enabled. A readout is responsive to external interrogation for externally communicating the current coin-count.

In its position between the coin-receiving mechanism and the machine controller, electrical removal or alteration of the electrical function of the coin tracker device either interrupts, in the case of serial electrical connection, or holds to a constant ground or voltage condition, in the case of parallel electrical interconnection, communication of the coin-received signal from the coin-receiving mechanism to the machine controller. Accordingly, any removal of the coin tracker device, or defeat of its function, serves to disable the machine function.

The present invention can, alternatively, be considered to be embodied in a coin tracker device for keeping track of the money entered into a money-operated apparatus substantially independently of the apparatus and its function; save only that electrical signals normally produced within the apparatus upon the entrance of money into the apparatus are accessed non-disruptively to the apparatus and its function.

The coin tracker device so functioning includes an electronic money counter that receives electrical signals normally produced within the apparatus upon the entrance of money into the apparatus so as to electronically maintain a record of money entered into the apparatus. The money counter includes an interrogatable and resettable first electronic counter that maintains a count of monies entered into the apparatus since a previous interrogation readout. This interrogatable first electronic counter resets to a zero count upon each and every occasion of its interrogation readout. The money counter also includes an interrogatable and unresettable second electronic counter that maintains a running grand total count of the a record of monies ever entered into the apparatus. This grand total count of the interrogatable second electronic counter is incapable of being zeroed or reset during interrogation readout or otherwise.

Finally, the coin tracker device includes an electronic readout means that produces electronically-detectable readouts of both the count from the first electronic counter, and the grand total count from the second electronic counter, of the electronic money counter means.

Because the money counter means is electronic, the count of its first electronic counter and the grand total count of its second electronic counter are not directly discernable by the human senses. Because the money counter means is electronic, any attempt to alter, as for purposes of fraud, either or both the count of its first electronic counter and the grand total count of its second electronic counter must necessarily be electronic and not mechanical. But, because the grand total count of the second electronic counter of the money counter means is incapable of being zeroed or reset, as for purposes of fraud, any electronic zeroing or reset, should such even be possible, of the count of the first electronic counter will not escape detection by a supervisory party so long as such supervisory party is in or comes into possession of successive grand total counts upon the occasions of successive readouts.

Accordingly, and because the readout produced by the electronic readout means are electronically detectable, any unauthorized and abnormal manipulation of either or both the count of the first electronic counter, and the grand total count of the second electronic counter, should such even be possible as for purposes of fraud, will be completed because any attempted validation of such manipulation by the electronically-detectable readouts requires such electronic means for receiving these readouts, and such knowledge for interpreting them, as may not be available to the party performing the unauthorized and abnormal manipulation.

Still further, the money tracker device of the present invention is expandable into a complete system in accordance with the present invention for according improved security in keeping track of the money entered into a money-operated apparatus. Such a system includes an electronic money counter for electronically maintaining a count of monies entered into the apparatus since a previous readout and a grand total count of monies ever entered into the apparatus. This count and grand total count of the electronic money counter are abnormally manipulatable—such as for purposes of fraud—if at all only but electronically.

The system also includes an electronic readout means for producing readouts of the total from the first electronic counter, and the grand total from the second electronic counter, of the electronic money counter. A transportable electronic sensor for receives and stores the readouts, and further controllably outputs such stored readouts when directed to do so. A central computer serves to direct the transportable electronic sensor to output the stored readouts, and receiving the readouts so output, for displaying the readouts in a manner in which a human analyst may determine whether monies collected from the apparatus are in agreement with monies recorded as entered into the apparatus.

The present invention is also, alternatively, embodied in a tamper resistant coin-operated machine. The machine includes a normally-closed coin-receiving electrical switch that momentarily electrically opens upon each receipt of a coin. A coin tracker circuit is connected to and through the switch upon a signal line. The coin tracker circuit generates a detectable electrical signal, typically a square wave, on the signal line. This signal is transmitted through the switch when it is closed and routed in a closed loop back to the coin tracker circuit as an input signal. (Obviously the signal is interrupted when the switch is open.)

The coin tracker circuit detects any prolonged absence of the detectable electrical signal on the signal line as an indication that the coin tracker means is itself abnormally electrically disconnected from the coin-receiving electrical switch, and/or that the coin-receiving electrical switch is abnormally jammed electrically open. The coin tracker circuit also detects any momentary absence of the detectable electrical signal on the signal line as an indication that the switch has received a coin. In this eventuality, the coin tracker circuit generates a coin-received output signal. A machine controller is responsive to the coin-received signal received from the coin tracker means for enabling the normal function of the coin-operated machine.

The coin tracker circuit normally includes a coin counter that counts the number of times that the coin-received electrical signal is received. The number of such occurrences is logged in order to maintain a current coin-count representing the total number of coins received into the coin-receiving electrical switch.

The coin tracker circuit preferably also includes a power outage detector that detects any outages of power to the coin tracker means due to power down or power disconnection, and that logs any such power outages.

A reporting capability of the coin tracker circuit is responsive to external interrogation for communicating externally to the coin tracker circuit, and to the machine, any of (i) the current coin-count and (ii) any detected abnormal electrical disconnects from the coin-receiving electrical switch, and (iii) any detected power outages. Any excessive number of reported abnormal electrical disconnects and/or power outages may reveal that the coin tracker module, and/or the machine, is being subject to unauthorized manipulation. The coin tracker circuit is correspondingly protected against tampering due to disconnection of its normal input signals, or its power.

The coin tracker circuit preferably still further includes a capability for monitoring, as well as generating, the coin-received output signal that it supplies to the machine controller. In this manner the coin tracker circuit not only drives the coin-received signal, but monitors itself the results of its signal drive. If the detectable electrical signal (the square wave) generated by the coin tracker circuit is detected on the output signal then an untoward occurrence, namely the jumpering of an input of the coin tracker means to an output of the coin tracker means, has occurred. Accordingly, the coin tracker circuit is correspondingly also protected against tampering due to jumpering of any of its normal input signals to any of its output signal lines.

As well as logging, and externally reporting, untoward electrical discontinuity, continuity and/or power events, the coin tracker circuit preferably operates so as to subsequently suspend generation of the output signal to the machine controller, thereby disabling machine operation, even should the untoward condition later be abated. In this manner a coin-operated machine that is resistant to tampering with the receipt, and the indelible logging, of received coins is created. Combined with external reporting, such an anti-tamper capability makes a coin-operated machine resistant to either unauthorized (unpaid) fraudulent appropriation of the services (e.g, games playing) that it provides or embezzlement of the funds (coins) that the machine receives.

These and other aspects and attributes of the present invention will become increasingly clear upon reference to the following drawings and accompanying specification.

BRIEF DESCRIPTION OF THE DRAWINGS

FIG. 3 is block diagram of a third embodiment of a coin tracker device in accordance with the present invention connected to, and in use within, a pre-existing coin-operated machine.

FIGS. 4-1 and 4-2 is an electrical schematic diagram of the first embodiment of a coin tracker device in accordance with the present invention previously seen in FIG. 1.

Figures 1, 4:
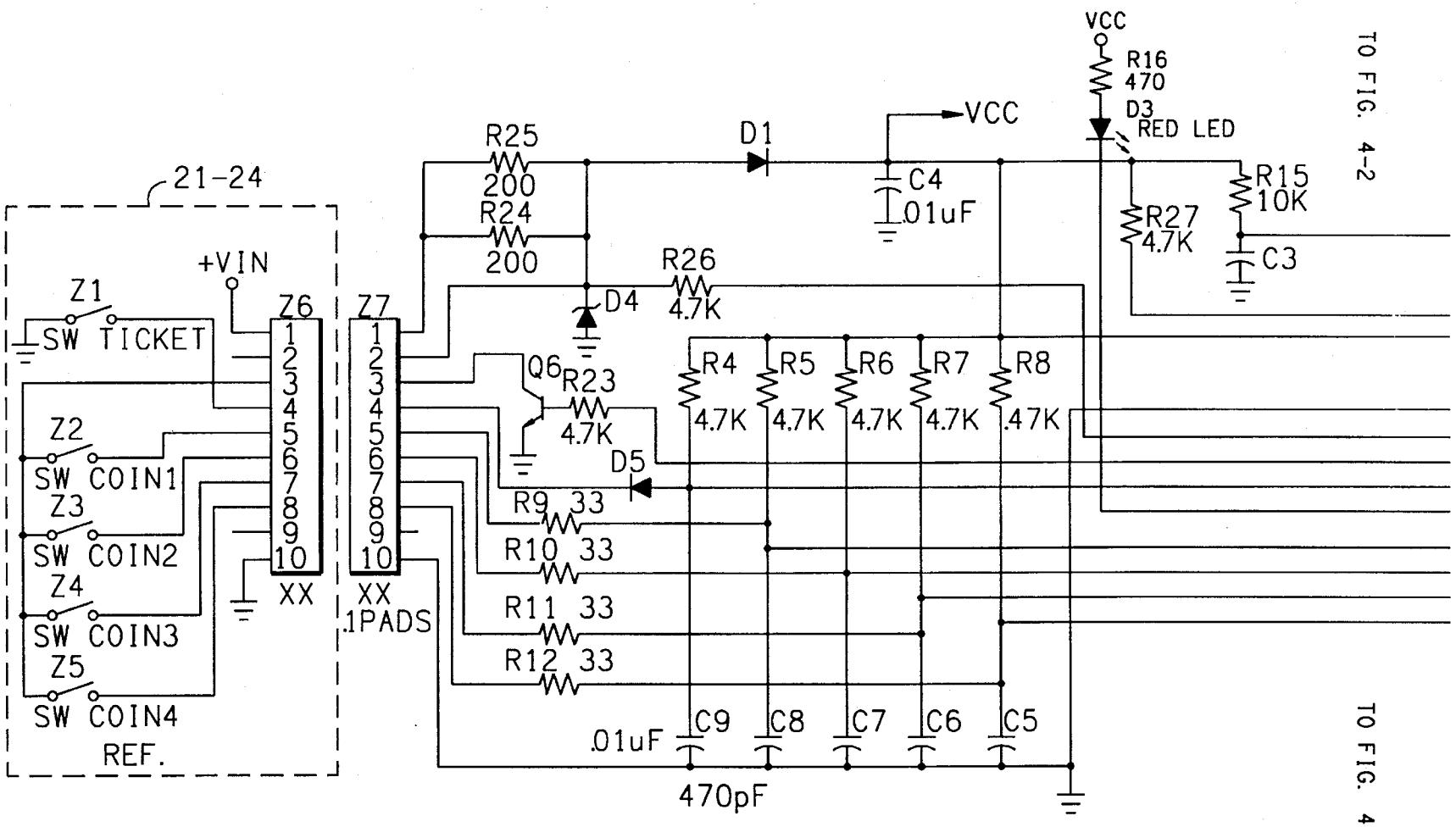
Figures 2, 4:
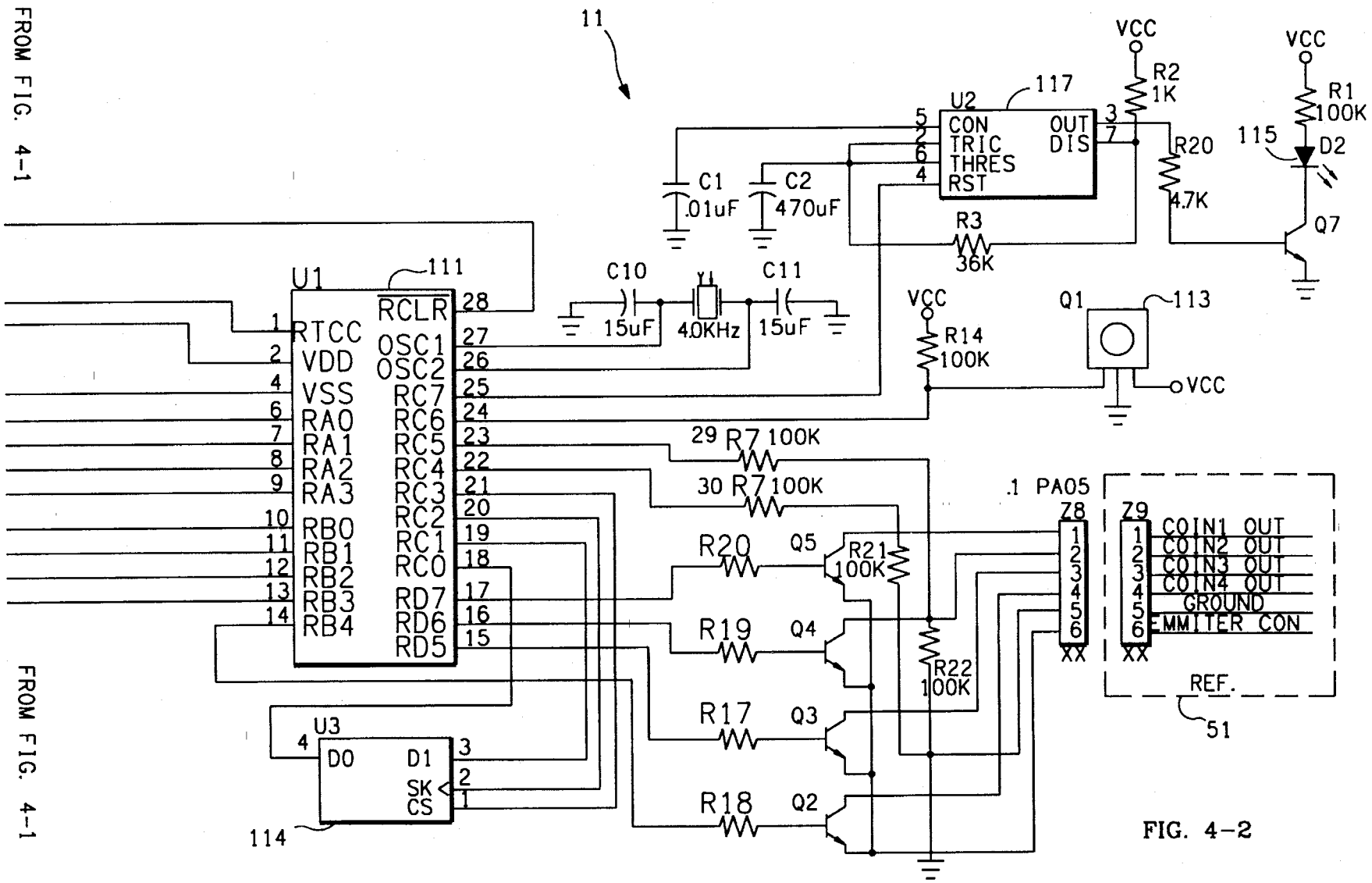

FIG. **4*a* is a diagrammatic representation of the various counters stored in EEPROM memory 114, previously seen in FIG. 4**.

Figure 1:
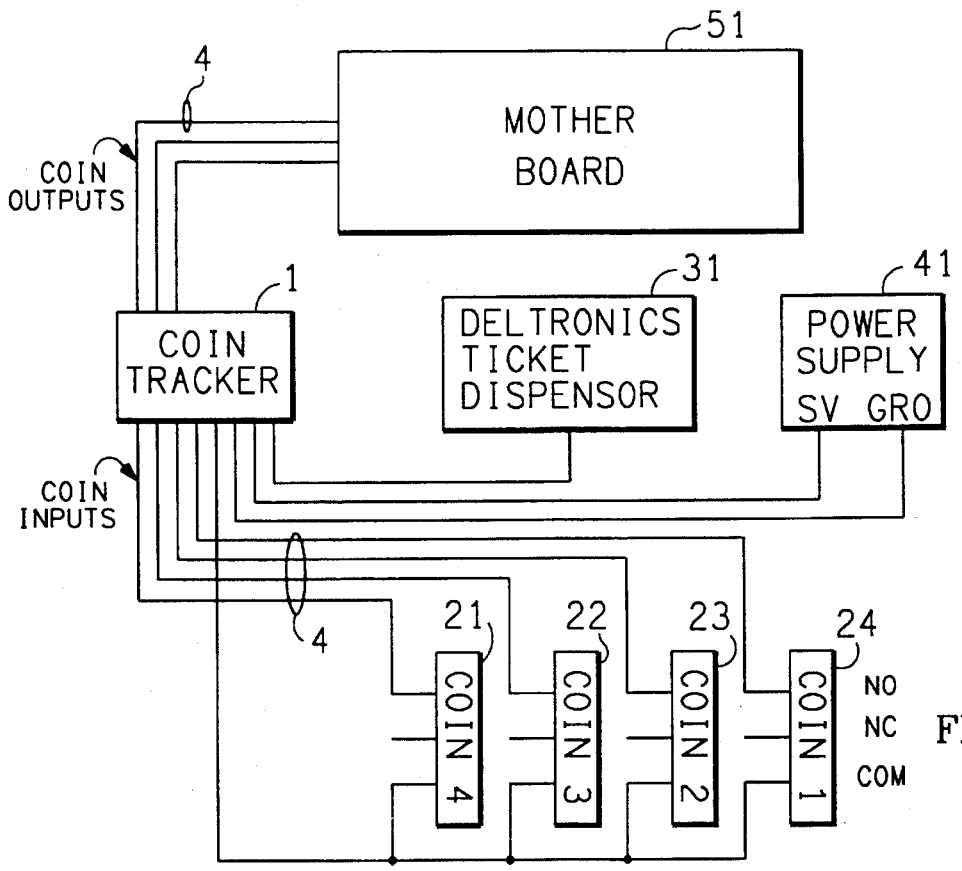
FIG. 1 is block diagram of a first embodiment of a coin tracker device in accordance with the present invention electrically serially connected to, and in use within, a pre-existing coin-operated machine.

FIG. 5 is mechanical schematic diagram of the first embodiment of a coin tracker device in accordance with the present invention previously seen in FIGS. 1 and 4.

FIG. 6 is a flow chart of the firmware program executed by the microprocessor within each embodiment of a coin tracker in accordance with the present invention.

Figure 7A:
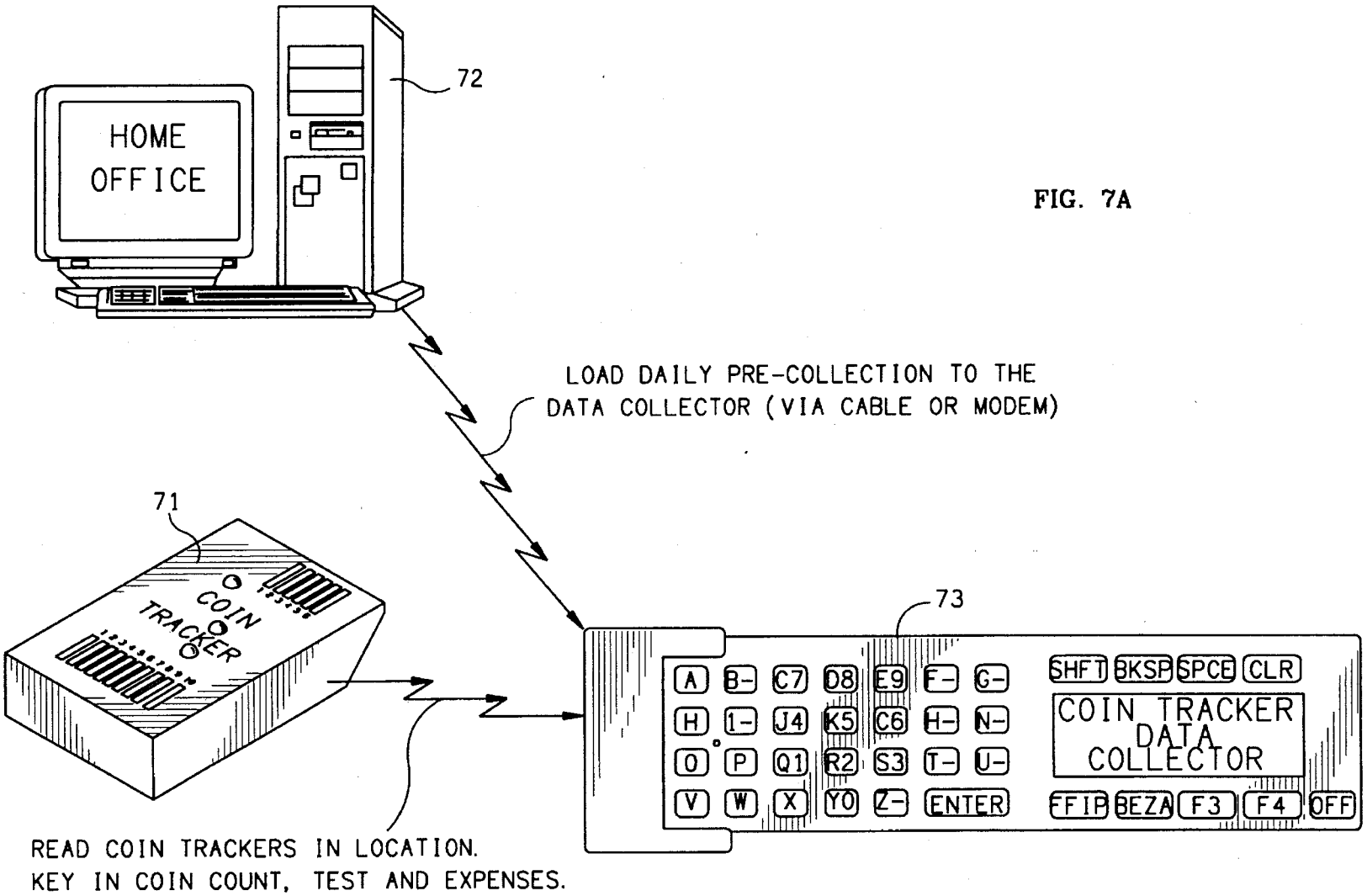
Figure 7B:
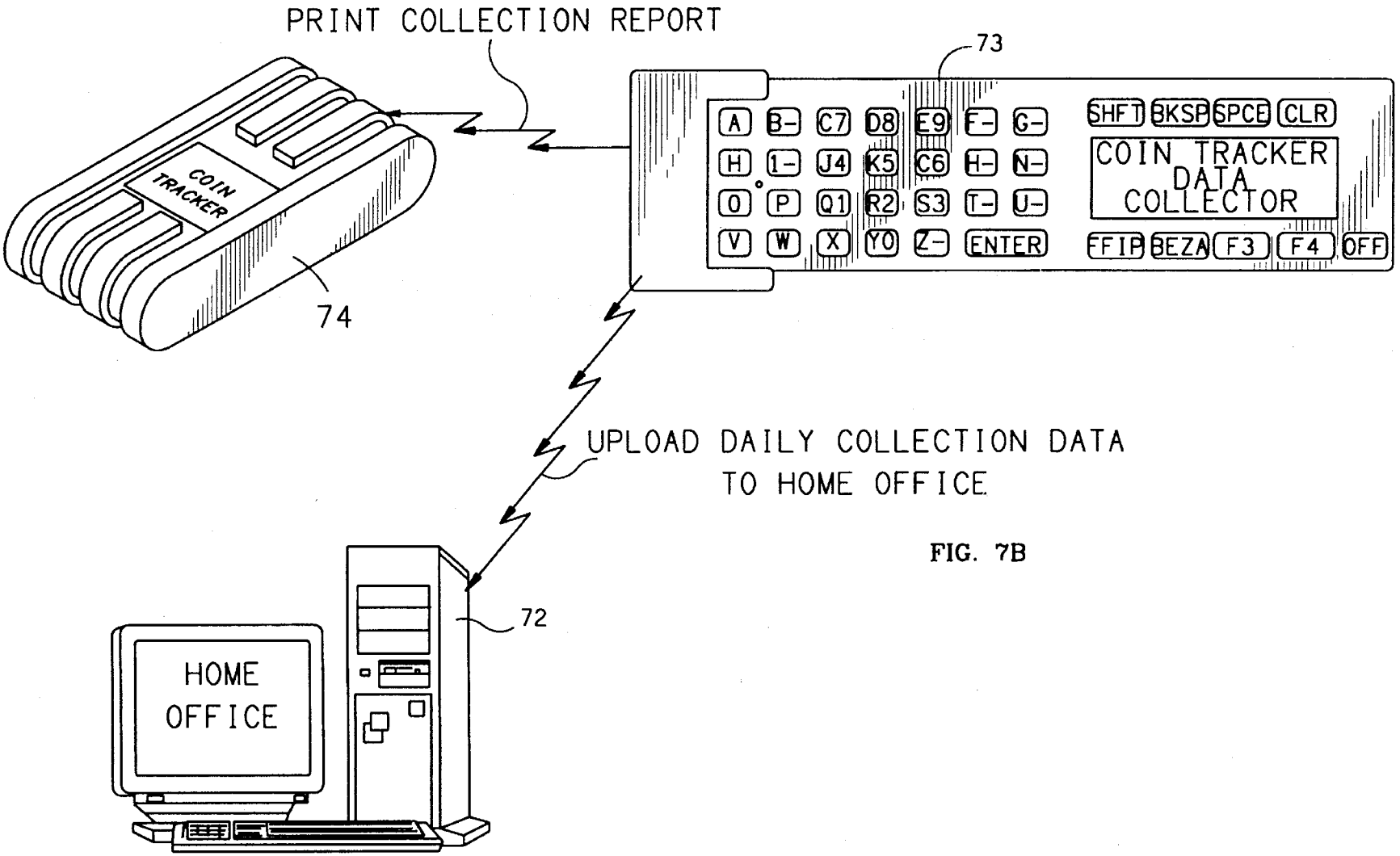

FIG. 7, consisting of FIG. 7*a* and FIG. 7*b*, is a diagrammatic illustration of a complete automated collection system, including one or more coin trackers located within coin-operated machines, in accordance with the present invention.

DESCRIPTION OF THE PREFERRED EMBODIMENT

1. Overview of a Coin Tracker, and Coin Tracker Data Collection System, in Accordance with the Present Invention The present invention provides the means to keep track of the money in a coin-operated machine, particularly a coin-operated amusement game, from the time it is entered to the time it is collected. This is accomplished by an electronic coin meter called a coin tracker module, or coin tracker. The information accumulated by the coin tracker is communicated to a hand-held computer via an infrared link. This information is then transferred to a central office personal computer via (i) a direct, wired, connection, or (ii) another infrared link, locally or remotely (iii) via a modem. The transferred data residing in the central office personal computer is in a standard import format compatible with commercially available data bases or spread sheet packages.

1.1 Record Keeping By the Coin Tracker

The coin tracker normally keep track of the following information:

The coin tracker keeps track of a 12 digit unique identification number. This number is paired with a serial number of a coin-operated machine (commonly a video game). The relationship between the two numbers is held and maintained in a centralized data base off site from the coin-operated machine (game) at a central office.

The coin tracker maintains four ascending 6 decimal digit coin meters. Total and differential counts are maintained. Ultimately the counts reported from these meters are managed by the central office.

The coin tracker maintains an ascending 6 decimal digit decimal coin meter which equals the total count of the four coin meters and is never reset.

The coin tracker monitors coin inputs and provides, when necessary, signal outputs to the electronic control circuit, or mother board, of the game. Alternatively, the coin tracker can be entirely passive, and can simply monitor coin-related signal outputs arising from the machine control circuit, or mother board.

The coin tracker maintains an ascending 6 digit decimal power interruption counter that counts the number of times the game was powered down.

The coin tracker maintains an ascending 3 digit decimal disconnection counter which counts the number of times the coin switches were disconnected.

1.2 Nominal Coin Tracker Hardware Physical Specifications

The coin tracker is typically implemented on a meter board (a small size printed circuit board). A microprocessor, infrared communication interface, and EEPROM for data storage are entirely contained on one board.

A simple and inexpensive mass terminated wiring harness provides a connection for the coin tracker meter board to machine coin-input signals, and generates simulated coin impulse signals to the machine control mother board (where required).

A high energy storage capacity capacitor with carbon paste electrodes, commonly called a super capacitor, powers the coin tracker for an un-determined period of time, typically more than eight hours, when primary power source has been turned off.

The coin tracker operate off either the game power supply or its back-up supercapacitor power source.

The coin tracker printed circuit board is physically housed in a non-conducting, cure drying, potted epoxy housing. This entire assembly is referred to a coin tracker module. It is typically 1.5" high, 2" wide, and 0.50" in depth, or smaller. Its appearance is normally flat black in color.

The mounting attachment of the coin tracker module to a coin-operated machine (commonly a video game) is preferably double sided sticky foam tape with contact area of 2 square inches minimum.

An indentation in the coin tracker encapsulation provides necessary alignment for an infrared light communications interface to a hand-held computer.

1.3 Nominal Coin Tracker Hardware Electrical Specifications

The nominal circuit power for the coin tracker is +5 volts DC. The coin tracker is electronically protected from failure due to reversed connection to its primary power supply.

Signals appearing on each signal input wire to the coin tracker, each of which wires typically connects in common to a coin switch, are electronically into the coin tracker. All signal inputs are normally pulled-up. All signal inputs have noise-limiting capacitors and/or diode protection.

A power failure signal is provided to the micro-processor. The signal level goes low when power is failing or failed. Failure is determined when 5 volts game power supply has dropped below 4.75 volts.

A supercapacitor-based backup power storage is capable of maintaining power to the coin tracker module for an undetermined time after primary input power has failed.

1.3 Nominal Coin Tracker Firmware Specifications

The coin tracker contains a microprocessor that runs a firmware program in order to implement the functional features of the coin tracker.

The coin tracker, and its firmware program, responds to one or more input signals called "count inputs". The definition of a count input is established as follows: Each of the coin-received switches of the machine (which the coin tracker serves to monitor) is rewired so as to be normally closed. The switch common signal of each switch is wired separately so that such signal is no longer connected to ground (as is common). Instead, the switch common signal is connected to the coin tracker. The coin tracker generates a square wave on the switch common signal line. This signal is transmitted through each switch that is closed (i.e, which exhibits electrical continuity) back to the coin tracker module as an input signal. The coin tracker coin monitors this square wave on its signal input lines.

The coin tracker firmware determines valid coin inputs as a high level input signal on an associated input signal line for a short time period corresponding to the actuation of the coin-received switch by a coin. The minimum and the maximum of this short time period must be within expected limits.

1.4 Coin Tracker Anti-Tampering

Conversely to the normal detection of the receipt of a coin as just previously explained in section 1.3 above, if any coin tracker switch input signals go high (input signals are pulled up by pull-up resistors) for longer then a predetermined period, then either (i) a disconnection has taken place or (ii) a coin switch is jammed. This is one major way that the coin tracker module can determine untoward occurrences, and possible tampering.

The coin tracker module has still further anti-tampering detection, and also serves to detect the cross-connection, or jumpering, of signal lines and signals. Output signals from the coin tracker to the control circuit, or mother board, of the coin-operated machine from the coin tracker are monitored by the coin tracker itself. In other words, the coin tracker not only drives certain output signals, but monitors the results of its signal drive. If a square wave corresponding to the one generated by the input signals to the coin tracker is detected then an untoward occurrence, namely the jumpering of the coin tracker's inputs to its outputs, has occurred. Such an occurrence likely has transpired due to some amateurish attempt to defeat, or evade, the monitoring function of the coin tracker. In the event of such a detected occurrence, the output signals to the mother board are subsequently clamped to a low condition, disabling machine operation, until the power is cycled off and on.

The coin tracker is able to detect a power down or disconnection. Such occurrences are logged. An excessive number of such may mean that the coin tracker module, and/or the machine that it monitors, are being subject to unauthorized manipulation(s). During such occurrences data integrity is always preserved—the basic data storage being in electrically non-volatile EEPROM memory.

1.5 Coin Tracker System Software Specifications

The coin tracker system central office data base typically contains the following information fields:

The hand-held computer receives data from each coin tracker on the numbers of (i) coin counts, (ii) power interruptions, and (iii) disconnection faults, and also the (iv) time and date, and (v) machine (game) serial numbers.

The hand-held receives data from its human user/operator on (i) exact collection times, (ii) missing machines or collections data, and/or (iii) uncollected site data.

The hand-held computer receives data from the central personal computer regarding the route on which it is (prospectively) to be used. This data includes (i) site to game to coin tracker serial number relationship data, (ii) site names, (iii) site locations, and, as necessary, (iv) additional site information such as persons to contact, etc.

The basic, rudimentary, report generated on the personal computer at the central office typically includes (i) the day's collection sites and amounts, (ii) "days since collection(s)" report for all sites where collections have not transpired within (n) days where (n) is appropriate to the activity, and (iii) a top 10% machines earnings report.

1.6 Communications Protocol Between the Coin Tracker and the Hand-Held Computer

The hand-held computer interfacing with the coin tracker is preferably a LASER-WAND® type real-time portable scanner available from Hand Held Products, 8880 Corporate Center Drive, Charlotte, N.C. 28247 (LASER-WAND® is a registered trademark of Hand Held Products). The coin tacker follows a communications protocol on its infrared interface which protocol is suitable to permit communication with this device. Complete, bi-directional, communications normally transpire in the period of just a few milliseconds. For this period of time the machine (the game) is normally not enabled for use (for play). Additionally, because the microprocessor of the coin tracker module is directing communications with the hand-held computer, no monitoring takes place while the coin tracker is transferring data.

2. Preferred Embodiments of the Present Invention 2.1. First Embodiment of a Coin Tracker in Accordance With the Present Invention: The "Input/Output Video Game Coin Tracker"

The first preferred embodiment of a coin tracker in accordance with the present invention provides high level security, game accounting information, and collection automation for the coin operation industry. The first embodiment of the coin tracker intercepts coin-received signals as input signals and, in turn, provides output signals to the logic board authorizing a game credit. With this method of installation, the coin tracker must be in-line or the game cannot be credited.

A block diagram of the first embodiment of a coin tracker 1 in accordance with the present invention—electrically serially connected to, and in use within, a pre-existing coin-operated machine—is shown in FIG. 1. All elements in the Figure save coin tracker 1 are shown in phantom line for being part of the environment of the invention, and not the invention itself.

The coin tracker 1 receives input signals called COIN INPUTS from up to four coin-receiving mechanisms 21–24. A signal received from a Beltronics Ticket Dispenser 31 permits the coin tracker 1 to keep track of redemption tickets issued by the machine. (Redemption tickets are commonly redeemable at a central stand of the gaming arcade for small prizes, souvenirs, mementoes of play etc.) Power to the coin tracker is supplied by Power Supply 41, which may itself be a regular power supply of the coin-operated machine or, alternatively, a dedicated supply which itself receives a.c. line power (not shown).

The coin tracker 1 records all incidences of the receipt of coins, and supplies signals to the control circuit of the game, or mother board 51, which signals mimic the receipt of coins.

The input connections to the first preferred embodiment of the coin tracker are:

| Terminal | Connection |
|---|---|
| 1 | 12 volts DC power (min 7.0 vdc, max 14.0 vdc) |
| 2 | 5 volts DC power (min 5.0 vdc max 6.9 vdc) |
| 3 | Coin switch common |
| 4 | Spare meter (no output connection) |
| 5–8 | Incoming coin signals (switch closures to ground). |
| 9 | No function |
| 10 | Game ground |

NOTE: The coin tracker requires either 5 or 12 vdc power, but not both.

The output connections to the first preferred embodiment of the coin tracker are:

| Terminal | Connection |
|---|---|
| 1–4 | Open collector output to logic board |
| 5 | Emitter common |

-continued

| Terminal | Connection |
|---|---|
| 6 | Game ground |

The features of the first preferred embodiment of the coin tracker include: It is easy to use and install. It may be connected using 22-gauge connectors and wire, and simple hand tools. It has secure packaging and a compact size. No service or repair is scheduled, nor normally required. The coin tracker possesses a unique ID number. It supports two-way 1200 baud infrared communications. Both its program and data memories are non-volatile. Protection against system tampering is built in. Both previous and current coin meters are implemented. All coin meters are non-resettable. There is a time-on meter. Self-test is supported, with results indicated by a flashing test LED. A count of all power-down events is maintained.

The first preferred embodiment of the coin tracker interfaces with most all types of video games, pinball games and gaming machines. It operates on most all types of coin operated equipment where a coin is normally registered by means of switch closure to ground.

The description of the data that is uploaded from the Coin Tracker to the hand-held computer via infrared two-way communications is as follows. This "Data Block" is standard with all embodiments of infrared-communicating coin tracker modules in accordance with the present invention.

| Field # | Field Description | Coin Tracker Data |
|---|---|---|
| 1 | Coin Tracker Serial Number | 123456789012 |
| 2 | Power Downs | 12345678 |
| 3 | Current Coin Meter #1 | 12345678 |
| 4 | Current Coin Meter #2 | 12345678 |
| 5 | Current Coin Meter #3 | 12345678 |
| 6 | Current Coin Meter #4 | 12345678 |
| 7 | Previous Coin Meter #1 | 12345678 |
| 8 | Previous Coin Meter #2 | 12345678 |
| 9 | Previous Coin Meter #3 | 12345678 |
| 10 | Previous Coin Meter #4 | 12345678 |
| 11 | Spare Meter | 12345678 |
| 12 | Time On | 12345678 |
| 13 | Tampering Codes | 12345678 |

The Coin Tracker "Data Block" is uploaded to the hand-held in Binary Coded Decimal (BCD) format and is converted to ASCII comma delimited format within the hand-held. When the "Data Block" is uploaded from the hand-held to the home office PC it is in standard ASCII comma delimited format 2.2 Second Embodiment of a Coin Tracker in Accordance With the Present Invention: The "Input/Output Relay Output Coin Tracker"

As with the first embodiment, the second preferred embodiment of a coin tracker in accordance with the present invention provides high level security, game accounting information, and collection automation for the coin operated industry. The second embodiment of the coin Tracker serves to provide an output signal to the game controller which output signal authorizes a game credit, or play. The second embodiment of the coin tracker must be installed in-line, and operative, to provide this signal or else the game cannot be credited, and played.

Figure 2:
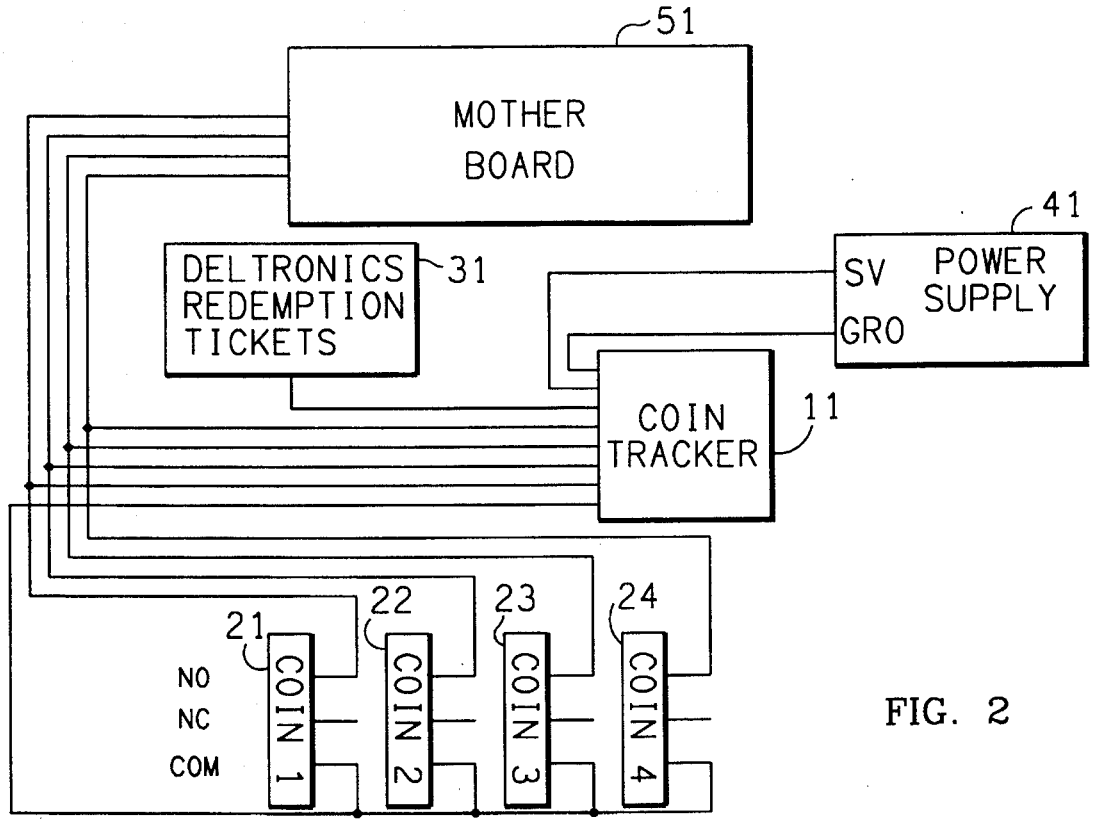
FIG. 2 is block diagram of a second embodiment of a coin tracker device in accordance with the present invention connected in electrical parallel to, and in use within, a pre-existing coin-operated machine.

A block diagram of the second embodiment of a coin tracker 11 in accordance with the present invention—connected in electrical parallel, and in use within, a pre-existing coin-operated machine— is shown in FIG. 2. All elements in the Figure save coin tracker 11 are again shown in phantom line for being part of the environment of the invention, and not the invention itself.

The coin tracker 11 taps in electrical parallel with the mother board 51 the input signals from up to four coin-receiving mechanisms 21–24. A signal received from a Beltronics Ticket Dispenser 31 permits the coin tracker 1 to keep track of redemption tickets issued by the machine. (Redemption tickers are commonly redeemable at a central stand of the gaming arcade for small prizes, souvenirs, mementoes of play etc.) Power to the coin tracker is supplied by Power Supply 41, which may itself be a regular power supply of the coin-operated machine or, alternatively, a dedicated supply which itself receives a.c. line power (not shown).

The coin tracker 1 records all incidences of the receipt of coins. If needs be, it can short the coin-received signals supplied to itself, and to the to the control circuit of the game, or mother board 51, to ground. In such an event use (play) of the machine (the game) is disabled.

The input connections to the second preferred embodiment of the coin tracker are the same as the first embodiment, namely:

| Terminal | Connection |
|---|---|
| 1 | 12 volts DC power (min 7.0 vdc, max 14.0 vdc) |
| 2 | 5 volts DC power (min 5.0 vdc max 6.9 vdc) |
| 3 | Coin switch common |
| 4 | Spare meter (no output connection) |
| 5–8 | Incoming coin signals (switch closures to ground). |
| 9 | No function |
| 10 | Game ground |

NOTE: The coin tracker requires either 5 or 12 vdc power, but not both.

The output connections to the second preferred embodiment of the coin tracker are the same as the first embodiment, namely:

| Terminal | Connection |
|---|---|
| 1–4 | Open collector output to logic board |
| 5 | Emitter common |
| 6 | Game ground |

The features of the second preferred embodiment of the coin tracker are the same as the previous, first, embodiment.

The second preferred embodiment of the coin tracker in accordance with the present invention is also designed to interface with most all types of coin-operated video games, pinball games and gaming machines. The second embodiment of the coin tracker operates on most types of coin-operated machines where receipt of a coin is registered by means of a switch closure to ground.

The data that is uploaded from the second embodiment of the coin tracker to the hand-held computer via infrared two-way communications is the same as the first embodiment of the coin tracker.

2.3 Third Embodiment of the Video Game Coin Tracker: AC/DC Voltage Replacement Meter Coin Tracker As with the two previous embodiments, a third preferred embodiment of a coin tracker in accordance with the present invention provides high level security, game accounting information, and collection automation for the coin operated industry. The third embodiment of the coin Tracker replaces or parasitically monitors the mechanical coin meter and is installed on the output side of the logic board.

A block diagram of the third embodiment of a coin tracker 12 in accordance with the present invention within, and in use within, a pre-existing coin-operated machine is shown in FIG. 3. The coin tracker 12 is connected so as to monitor a mechanical coin meter 52, and is installed in electrical parallel with this coin meter 52 on the output side of the mother board 51. All elements in FIG. 3 save coin tracker 11 are again shown in phantom line for being part of the environment of the invention, and not the invention itself.

The mother board 51 receives input signals from up to four coin-receiving mechanisms 21–24. Power to the coin tracker 12 is not shown. The coin tracker 12 serves as an electronic coin counter which, while dependent upon mother board 51 for input signals, may not be reset nor disconnected (without detection via reporting) so easily as may coin meter 52.

The input connections to the third preferred embodiment of the coin tracker are:

| Terminal | Connection |
|---|---|
| 1 | 12 to 48 volts AC or DC power (min 7.0 vdc max 14.0 vdc) |
| 2 | Power supply common (min 5.0 vdc max 6.9 vdc) |
| 3–4 | Input 1 AC/DC |
| 5–6 | Input 2 AC/DC |
| 7–8 | Input 3 AC/DC |
| 9–10 | Input 4 AC/DC |

The features of the third preferred embodiment of the coin tracker are the same as previous embodiments.

The third preferred embodiment of the coin tracker in accordance with the present invention is designed to replace the mechanical coin meter in either AC or DC powered (12 to 48 volts). It interfaces with most types of gaming equipment.

The data that is uploaded from the third embodiment of the coin tracker to the hand-held computer via infrared two-way communications is standard with each of the other embodiments of the coin tracker.

2.4 Fourth Embodiment of the Video Game Coin Tracker: DC Voltage Meter Replacement Coin Tracker As with previous embodiments, the fourth preferred embodiment of a coin tracker in accordance with the present invention provides high level security, game accounting information, and collection automation for the coin operated industry. The fourth embodiment of the coin tracker either replaces, or parasitically monitors, the mechanical coin meter. It is again installed on the output side of the logic board.

The fourth embodiment of the coin tracker is installed equivalently as is the third embodiment shown in FIG. 3, and is, accordingly, accorded no separate Figure.

The input connections to the fourth preferred embodiment of the coin tracker are:

| Terminal | Connection |
|---|---|
| 1 | 12 volts DC power (min 7.0 vdc, max 14.0 vdc) |
| 2 | 5 volts DC power (min 5.0 vdc, max 6.9 vdc) |
| 3 | Power supply common |
| 4 | Spare meter (open collector output) |
| 5–6 | DC input 1 |
| 7–8 | DC input 2 |
| 9–10 | DC input |

NOTE: The coin tracker requires 5 or 12 vdc power, but not both.

The fourth preferred embodiment of the coin tracker interfaces with most all types of video games, pinball games, and gaming machines. It operates on most all types of coin operated equipment where a DC pulsating mechanical coin meter also operates.

3.1 Electrical Schematic of the First Preferred Embodiment of the Coin Tracker in Accordance With the Present Invention An electrical schematic diagram of the first embodiment of a coin tracker device in accordance with the present invention, previously seen in the block diagram of FIG. 1, is shown in FIG. 4. The coin tracker 11 is connected in electrical serial intermediary the coin switches 21–24 and the machine control circuit, or mother board, 51.

The coin-received signals are filtered in resisters and capacitors and applied as input signals to the microprocessor 111 chip U1 type MC16C57XT/S0. Output infrared light communication is realized though communications driver 112 type KS555DT and output light-emitting diode (LED) 115 element D2 type LTE4208C. Similarly, input communication is realized through the detection of infrared light in detector 113 element Q1 type 1S1U60L.

A firmware program executed by microprocessor 111, and data maintained by the microprocessor 11, are stored in EEPROM memory 114, chip U3 type MC93C46SN. The various counters stored in EEPROM memory 114 are shown in FIG. 4*a*.

3.2 Mechanical Schematic of the First Preferred Embodiment of the Coin Tracker in Accordance With the Present Invention A mechanical schematic diagram of the first embodiment of a coin tracker device in accordance with the present invention, previously seen in the block diagram of FIG. 1 and in the electrical schematic diagram of FIG. 4, is shown in FIG. 5. The input and output signals, and the output light-emitting diode (LED) 115, and the infrared light detector 113 (both previously seen in FIG. 4) are visible.

3.3 Flow Chart of the Firmware Program

A flow chart of the firmware program executed by microprocessor 11 and stored in EEPROM memory 114 (shown in FIG. 4) is shown in FIG. 5. The firmware program has major cyclic loops to attend, in relative priority, to (i) communication, (ii) receipt of coins (and enabling of machine function responsively thereto, if relevant, and (iii) detection of tampering.

4. Functions of the Coin Tracker, and Coin Tracker System, of the Present Invention The purpose of the coin tracker data collection system in accordance with the present invention is to provide timely accounting information of high integrity to the central office of an owner/supplier of coin-operated machines, particularly coin-operated video game machines, while eliminating costly (i) fraudulent expropriation of machine-vended goods or services, (ii) embezzlement of monies collected by the machines, and (iii) errors associated with human-generated, handwritten, activity reporting. Other advantages the coin tracker data collection system include the anti-tampering security of the coin tracker hardware, and its relative ease of installation use.

The data collection system includes a coin tracker module (an electronic metering system) physically mounted and electrically connected within a coin-operated machine and operating under control of a microprocessor running a firmware program and a portable hand-held computer containing a relational data base. An infrared communications system between the module and the hand-held computer permits the interchange of data between the coin tracker module and the hand-held computer. The collection system also includes a software program and an IBM compatible personal computer (IBM is a registered trademark of International Business Machines, Inc.). The software program permits data recovered form the coin tracker modules by the portable hand-held computer to be uploaded to the personal computer by a direct, wired, interconnection. This program also permits the personal computer to receive telephone communications from the hand-held computer via a modem link. Data received by the personal computer is written to a file in an ASCII delimited format.

4.1 Overview of the Operation of a Coin Tracker, and Coin Tracker Data Collection System, in Accordance with the Present Invention In operation of a coin tracker module, and a complete coin tracker data collection system, in accordance with the present invention, a coin tracker module monitors and records all activity and receipts of a coin-operated machine. A route operator supporting the coin-operated machine collects data from each of a number of machines by aiming the hand-held computer line-of-sight at the coin tracker module, which is appropriately exposed to view. Data is transferred from the game coin tracker module to the hand-held computer via an infrared light communications link in less than a second. The process is than repeated for all the coin-operated games at a site, and at each of potentially many sites.

Money collected by each of the coin-operated machines is than counted by hand, and the amount of receipts is entered by hand into the hand-held computer.

A preliminary activity report is printed on site. After the operator of the machine enters the monies (ostensibly) received by the machine, and the amount of refunds due the manager of the premises upon which the machine is located, the totals of machine activities, the percentage splits between the machine operator and premises owner, and the net commission to be paid are all printed. Additionally, the date and time, the name and address of the route operator, and the current site are also printed.

The relational data base on the hand-held computer thus requires certain data to be uploaded from the central office personal computer—data such as the percentage splits—in order to print its reports. Collected data is downloaded to the home office computer at the end of the day remotely via a modem or directly via a communication cable. The program within the hand-held computer serves to interface a Hayes compatible modem to the central office personal computer. This program provides for unattended answering of incoming phone calls and handles all necessary file transfers.

4.2 Initialization of a Coin Tracker, and Coin Tracker in Accordance with the Present Invention After a coin tracker in accordance with the present invention is physically installed and electrically connected to a coin-operated machine then a process is performed to pair the unique serial number of the internal microprocessor of the coin tracker to the operator-assigned identification number of the coin-operated machine. This is accomplished by running an install program on the hand-held computers.

The install program opens with a menu of choices. This menu has three options: 1) Pair, 2) Send, and 3) Exit. The operator can select one of these options by pressing the first letter of the option or moving the cursor to the item and pressing the EXE key.

The Pair option is selected to read data from the Coin Tracker. The Send option is used to upload data to the central office personal computer. The exit option returns control to the main program menu.

During the pairing process information on the coin tracker module is read. The program then prompts the route operator for the game serial number and the number of test games played while testing the newly-installed coin tracker. After each game, the operator will be asked is another game is to be installed. If the operator enters 'N' then the program returns to the main menu. If the operator answers 'Y' then the process is repeated.

4.3 Detection of Tampering

A coin tracker in accordance with the present invention detects tampering with its internal microprocessor through a series of automated electrical checks and programmed tests. Through these tests any (i) bypassing (jumpering) and/or (ii) disconnection of the coin tracker are detected, and are reported to the owner/operator. Electrical continuity through the coin switches, and the electrical isolation of the coin tracker inputs from its outputs, are checked continuously while the unit is idle as well as during coin processing.

The coin tracker also monitors the electrical impedance characteristics of the machine to which it interfaces, and reports a tamper if the monitored characteristics deviate significantly from what is considered normal for that type of equipment.

Detected and reported tampering of all types may also be identified by software running in the central office (personal) computer through analysis of reported elapsed time and power on time data. The data reported by the coin tracker is compared with the normal operating hours of the machine being monitored.

5. An Automated Collection System

A diagrammatic illustration of a complete automated collection system, including one or more coin trackers located within coin-operated machines, in accordance with the present invention is shown in FIG. 7, consisting of FIG. 7*a* and FIG. 7*b*.

The coin tracker module 71 is normally one of the three embodiments previously discussed. It has the ability to identify and record all coin drops, redemption tickets out, power interruptions, time on and system tampering. Each coin tracker 71 has a unique identification number which, when coupled with the operator's assigned identification number of the coin-operated machine (game), provides a non-duplicate identity for every machine.

The "home office", or central computer, 72 is preferably a personal computer. It serves to "load daily pre-collection data to the Data Collector via cable or modem". The data collector 73 serves to receive and store this data, and also to "read coin trackers (71) in location", and to accept "key in count, tests and expenses".

The data collector 73 is preferably a Micro-Wand III hand-held computer terminal available from Handheld Products. It has a 32K program memory and a 128K random access data memory capable of holding full data on about 1000 machines before transfer becomes necessary. One keystroke implements infrared light communication with a coin tracker 71, looks up machine- and location-specific information, and uploads data from the coin tracker 71. The menu then prompts the collector to enter manually-derived coin count data. A final keystroke implements a printed receipt by a modem interface to a receipt printer.

The receipt printer 74 is preferably the O'Neil Receipt Printer available form Handheld Products. It is a ruggedized thermal printer designed to produce a clearly legible permanent record at 0.79 inches per second.

At the end of a collection route the collector sends the collected information back to the central computer 72 (as shown in FIG. 7*b*), and receives a new route for the following day automatically. An optional 2400 baud pocket modem (not shown) may interface with the hand-held computer 73 to permit transfer of logged data from the field to the central computer 72 (also equipped with a modem) over telephone lines.

5.1 Contents of the Printed Collection Ticket

The typical, preferred, contents of the collection ticket printed by the receipt printer 74 (shown in FIG. 7*b*) are as follows.

First, a location number (a four digit field) is downloaded from the central computer. The location number is keyed or bar-coded in by collector to begin location collection ticket. The hand-held computer stores all game information based on location number.

Second, an invoice number ( a six digit field) is downloaded from the central computer.

Third, the number of weeks since last collection (a four digit field), called "collect weeks", is downloaded from the central computer. The number of weeks since last collection also effects operators minimum and locations minimum (see items thirteen and fourteen).

Fourth, the time and date are generated in the hand-held computer.

Fifth, a machine alphanumeric designator (or number) (an eight digit field) is downloaded from the central computer. The machine designator, the number of the machine-coin tracker pair, and the coin tracker number are all printed on the collection ticket. (Pairing is done at the central office before machine is placed on location.) (Note: coin tracker rotation is handled like a machine rotation.)

Sixth, an alphanumeric description (a fifteen digit filed) is downloaded from the central computer. The description typically describes the type of machine, or the game name.

Seventh, previous meter information (an eight digit field) is uploaded from the coin tracker module. This previous information is typically the last week's meter reading.

Eight, current meter information (an eight bit field) is uploaded from the coin tracker module. The current meter is a perpetually on-going meter that cannot be changed or reset.

Ninth, a difference (a six digit field) is calculated in the hand held computer as the difference between the previous meter and the current meter.

Tenth, test credits (a three digit field) are manually entered by the collector. Test credits are the number of game credits issued without receiving cash.

Eleventh, a coin count (a six digit field) is manually entered by the collector. This count is the physical number of coins collected, and not the dollar amount.

Twelve, the dollar amount collected (an eight digit field) is calculated within the hand-held computer. Typically, the number of coins×0.25=the dollar amount. The multiplier per coin is downloaded from the central computer.

Thirteenth, the operator's minimum whole dollar amount (a five digit field) is downloaded from the central computer. The operator's minimum, or guaranteed amount, is a different dollar amount for each game. The guaranteed amount typically increases or decreases based on the number of weeks since the last collection.

For example, if the weeks since last collection equals one, and the operator's minimum is $25 per week, then the total operator's minimum is $25. For example, if the weeks since last collection is two, and the operator's minimum is $25 per week, then the total operator's minimum is $50. The central computer provides for a fractional number for optimum flexibility. For example, if the weeks since last collection is 1.5 and the operator's minimum is $25 per week, then the total operator's minimum $25×1.5= $31.25.

Fourteenth, a location minimum dollar amount (a three digit field) is downloaded from the central computer. The location minimum, or location guaranteed amount, is also a different dollar amount per each game. The location guaranteed amount also increases or decreases based on the number of weeks since the last collection. See the previous examples regarding the operator's minimum. The location minimum is satisfied after all operator's minimums at each location are satisfied.

Fifteenth, the location split is downloaded from the central computer as a percentage (a five digit field). The location split is loaded, and stored, as a percentage after the operator's minimums and location minimum have both been satisfied Sixteenth, a location dollar amount (an eight digit field) is calculated in the hand-held computer. The location dollar amount is calculated on a machine by machine basis in accordance with the following formula: (actual dollar amount–(operator minimum× collect weeks)–(location minimum×collect weeks))×location percentage+(location minimum×collect weeks)=location dollar amount.

Seventeenth, the operator dollar amount (an eight digit field) is calculated in the hand-held computer. The operator amount is calculated on a machine by machine basis and in accordance with the following formula: (actual dollar amount–(operator minimum× collection weeks)–(location minimum×collection weeks))× location percentage+(operator minimum×collection weeks)= operator dollar amount.

Eighteenth, a gross dollar amount (an eight digit field) is calculated in the hand-held computer. The gross dollar amount is the sum of all proceeds collected from all machines at a particular location. The operator and the location have separate gross dollar totals.

Nineteenth, refunds are manually entered by the collector (an eight digit field). A refund is the amount of money given or credited to the location.

Twentieth, taxes expressed as a percentage (a six digit field) are downloaded from the central computer. The tax amount for each location is calculated on the sub total or gross dollar refunds. The tax amount for the operator is calculated directly from the sub total or gross dollars (no refunds are entered for the operator). All taxes are brought in by the operator and paid from the central office.

Twenty-first, gross commissions of eight digits are calculated in hand-held computer. Gross commissions are the total commissions to be paid before expenses calculated by the following formula: gross dollar–refunds–taxes= gross commissions Twenty-second, miscellaneous expenses is an eight digit field manually entered by the collector. Expenses can be entered for the location and operator, and are subtracted from the gross commissions.

Twenty-third, net commissions of eight digits are calculated in the hand held computer. Net commissions are the sum of the moneys to be paid to the location and the operator. Net commissions are calculated separately for both location and operator by the following formulas: Location net commissions= gross dollars–refunds–taxes–location miscellaneous expenses. Meanwhile, operator net commissions=gross dollars–taxes–operator miscellaneous expenses.

Twenty-fourth, the operator total brought-in dollars of eight digits is downloaded form the central computer. If coded "y" for "yes" then the collector will (i) bring the total collection to the central office, and will (ii) pay out refunds and total brought-in by the following formula: operator net commission+location net commission+ taxes+ miscellaneous expenses= total brought-in dollars.

If coded "n" for "no" then the collector will (i) not bring the total collection to the central office, and will (ii) pay out net locations commissions and bring in net operator commission. The total brought in formula and amount will be: operator net commission–location net commission+ taxes+ miscellaneous expenses= total brought-in dollars.

Twenty-fifth, the collector signature/location signature is generated by the hand-held computer and printed.

Twenty-sixth, a check number is generated by hand held computer and printed.

5.3 File Transfer from the Central Computer to the Hand-Held Computer

The central computer 72 transfers an ascii comma delimited file to the hand-held computer 73 (both shown in FIG. 7*a*). The fields of this file are:

(1) location number (4 digits).

(2) invoice number (6 digits).

(3) tax rate (6 digits including a decimal).

(4) if yes: pay out money at location. If no: money is paid out from home office (3 letters).

(5) how many games to follow the header (3 digits).

(6) coin tracker module number (12 digits).

(7) machine number (8 alpha numeric digits).

(8) machine name (15 alpha numeric digits).

(9) weeks since last collection (5 digits including a decimal).

(10) currency multiplier rate (4 digits including a decimal).

(11) operator minimum in whole dollars (3 digits).

(12) location minimum in whole dollars, after (9) is satisfied (3 digits).

(13) location split share in %, after (9) and (10) are satisfied (5 digits including a decimal).

(14) an asterisk (*) symbol will separate each game file.

Items (1) through (5) occur once per location. Items (6) through (14) will occur as many times as item (5) dictates. No leading zeros are necessary in any field.

5.4 File Transfer from the Hand-Held Computer to the Central Computer

The hand-held computer 73 transfers an ascii comma delimited file to the central computer 72 (both shown in FIG. 7*b*). The fields of this file are:

(1) location number (4 digits).

(2) refunds (8 digits including a decimal).

(3) operator misc expense (8 digits including a decimal).

(4) location misc expense (8 digits including a decimal).

(5) date (8 digits).

(6) time (8 digits).

(7) coin Tracker module number (12 digits).

(8) machine number (8 alpha numeric digits).

(9) current meter #1 (8 digits).

(10) current meter #2 (8 digits).

(11) current meter #3 (8 digits).

(12) current meter #4 (8 digits).

(13) ticket meter (8 digits).

(14) time on (8 digits).

(15) tampering (8 digits).

(16) power Downs (8 digits)

(17) actual number of coins or bills (8 digits).

(18) an asterisk (*) symbol will separate each game file.

Items (1) through (6) occur once per location. Items (7) through (17) occur once per machine (per game). No leading zeros are necessary in any field.

6. Aspects and Attributes of the Present Invention

In accordance with the preceding explanation, certain adaptations and variations of the present invention will suggest themselves to practitioner of the electrical circuit design arts. The coin tracker could be adapted to monitor activity other than the mere receipt of coins such as, for example, the payout of coins by a slot machine. The coin tracker could be adapted to monitor any machine activity, not necessarily involving coins or any money whatsoever, which was otherwise susceptible to fraud. For example, if television viewing monitoring devices were alleged to be tampered with, a circuit like the coin tracker of the present invention could help assure the integrity of reported results.

Similarly, the monitoring and reporting scheme of the present invention—involving as it does the bi-directional interchange of information between (i) a central computer, (ii) a hand-held computer, and (iii) a machine is usable for more than coin-operated machines, and is useful for the maintenance, and maintenance reporting, of diverse machines from traffic lights to fire alarms which are normally considered too complex, or expensive, to monitor.

In accordance with these and other aspects and attributes of the present invention, the invention should be interpreted broadly, and in accordance with the following claims only, and not solely in accordance with those particular embodiments within which the invention has been taught.

What is claimed is:

1. An electronic coin tracker device for use with an electrical coin-operated machine having (i) a coin-receiving mechanism for producing a coin-received electrical signal upon the receipt of a coin, and (ii) a machine controller for enabling a machine function in response to receipt of the coin-received electrical signal, the device comprising:

receiver means for receiving the coin-received electrical signal from the coin-receiving mechanism;

coin counter means for counting the number of times that the coin-received electrical signal is received in order to maintain a current coin-count representing the number of coins received into the coin-receiving mechanism;

transmitter means for further communicating the coin-received electrical signal, after each receipt thereof is counted by the coin counter means, to the machine controller in order that the machine function is enabled;

readout means responsive to external interrogation for externally communicating the current coin-count; and a power interruption counting means for maintaining a power-interruption-count of the number of times that electrical power to the machine is interrupted, the readout means also responsive to external interrogation for externally communicating the power-interruption-count;

wherein electrical removal of the device from the coin-operated machine interrupts communication of the coin-received signal from the coin-receiving mechanism to the machine controller, and thus disables the machine function.

2. The electronic coin tracker device according to claim 1 wherein the receiver means is electrically serially connected between the coin-receiving mechanism and the machine controller for receiving the coin-received electrical signal.

3. The electronic coin tracker device according to claim 1 wherein the receiver means is connected in electrical parallel with the machine controller for receiving the coin-received electrical signal from the coin-receiving mechanism.

4. The electronic coin tracker device according to claim 1 for use with an electrical coin-operated machine having a plurality of coin-receiving mechanisms for producing upon receipt of coins an associated plurality of coin-received electrical signals, wherein the receiver means comprises:

a plurality of receivers for receiving the plurality of coin-received electrical signals from the plurality of coin-receiving mechanisms; and wherein the coin counter means comprises:

a plurality of coin counters, each for counting the number of times that a respective one of the plurality of coin-received electrical signals is received in order to maintain a current coin-count representing the number of coins received into a corresponding one of the plurality of coin-receiving mechanisms; and wherein the readout means comprises:

a data readout circuit responsive to external interrogation for externally communicating the plurality of current coin-counts from the plurality of coin counters.

5. The electronic coin tracker device according to claim 4 wherein the coin counter means further comprises:

a total coin counter for maintaining a total coin-count equal to the sum of the plurality of current coin-counts, the total coin-count representing the total number of coins received into all of the plurality of coin-receiving mechanisms.

6. The electronic coin tracker device according to claim 4 further comprising:

resetting means for resetting the plurality of coin counters to zero upon such times as the plurality of coin-counts is externally communicated by the data readout circuit.

7. The electronic coin tracker device according to claim 4 wherein the counter means further comprises:

a resettable total counter for maintaining a total coin-count equal to the sum of the plurality of current coin-counts, the total coin-count representing the total number of coins received into all of the plurality of coin-receiving mechanisms; and an unresettable total coin counter also for maintaining the same total coin-count as is maintained by the resettable total counter; and wherein the coin tracker device further comprises:

resetting means for resetting (i) the plurality of coin counters and (ii) the resettable total coin counter to zero upon such times as the plurality of coin-counts is externally communicated by the data readout circuit.

8. The electronic coin tracker device according to claim 1 for use with an electrical coin-operated machine also having a redemption-ticket-receiving mechanism for producing a redemption-ticket-received electrical signal upon the receipt of a redemption ticket wherein the machine controller is also for enabling a machine function in response to a receipt of the redemption-ticket electrical signal, the device further comprising:

supplemental receiver means for receiving the redemption-ticket-received electrical signal from the redemption-ticket-receiving mechanism;

redemption ticket counter means for counting the number of times that the redemption-ticket-received electrical signal is received in order to maintain a current redemption-ticket-count representing the number of redemption tickets received into the redemption-ticket-receiving mechanism; and wherein the readout means is also for externally communicating the current redemption-ticket-count responsive to external interrogation.

9. The electronic coin tracker device according to claim 1 further comprising:

tamper detection means for maintaining an tamper-indication upon all such times as the electronic coin tracker device has been physically tampered with;

wherein the readout means is also for externally communicating the tamper-indication responsive to external interrogation.

10. The electronic coin tracker device according to claim 1 wherein the readout means comprises:

an infrared light receiver responsive to external interrogation in the form of infrared light; and an infrared light transmitter for externally communicating the current coin-count in the form of infrared light.

11. An electronic coin tracker device for use with an electrical coin-operated machine having (i) a coin-receiving mechanism for producing a coin-received electrical signal upon the receipt of a coin, and (ii) a machine controller for enabling a machine function in response to receipt of the coin-received electrical signal, the device comprising:

receiver means for receiving the coin-received electrical signal from the coin-receiving mechanism;

coin counter means for counting the number of times that the coin-received electrical signal is received in order to maintain a current coin-count representing the number of coins received into the coin-receiving mechanism;

transmitter means for further communicating the coin-received electrical signal, after each receipt thereof is counted by the coin counter means, to the machine controller in order that the machine function is enabled;

readout means responsive to external interrogation for externally communicating the current coin-count; and coin-receiving mechanism disconnect counter means for maintaining a coin-receiving-mechanism-disconnect-count of the number of times that the coin receiving mechanism of the machine is disconnected from the receiver means, the readout means also responsive to external interrogation for externally communicating the coin-receiving-mechanism-disconnect-count;

wherein electrical removal of the device from the coin-operated machine interrupts communication of the coin-received signal from the coin-receiving mechanism to the machine controller, and thus disables the machine function.

12. A device for keeping track of the money entered into a money-operated apparatus substantially independently of the apparatus and its function save only that electrical signals normally produced within the apparatus upon the entrance of money into the apparatus are accessed non-disruptively to the apparatus and its function, the device comprising:

an electronic money counter means, receiving electrical signals normally produced within the apparatus upon the entrance of money into the apparatus, for electronically maintaining a record of money entered into the apparatus, the money counter means including an interrogatable and resettable first electronic counter for maintaining a count of monies entered into the apparatus since a previous interrogation readout, the interrogatable first electronic counter resetting to a zero count upon each and every occasion of its interrogation readout, and an interrogatable and unresettable second electronic counter for maintaining a running grand total count of the a record of monies ever entered into the apparatus, the grand total count of the interrogatable second electronic counter being incapable of being zeroed or reset during interrogation readout or otherwise;

an electronic anti-tamper sensor means for producing a signal upon such times as the device has been subject to tampering; and an electronic readout means for producing electronically-detectable readouts of each of the count from the first electronic counter, the grand total count from the second electronic counter, and any indication of tampering from the anti-tamper sensor means, of the electronic money counter means.

wherein because the money counter means is electronic, the count of its first electronic counter and the grand total count of its second electronic counter are not directly discernable by the human senses;

wherein because the money counter means is electronic, any attempt to alter, as for purposes of fraud, either or both the count of its first electronic counter and the grand total count of its second electronic counter must necessarily be electronic and not mechanical;

wherein because the grand total count of the second electronic counter of the money counter means is incapable of being zeroed or reset, as for purposes of fraud, then any electronic zeroing or reset, should such even be possible, of the count of the first electronic counter will not escape detection by a supervisory party so long as such supervisory party is in or comes into possession of successive grand total counts upon the occasions of successive readouts;

wherein because the readout produced by the electronic readout means are electronically detectable, any unauthorized and abnormal manipulation of either or both the count of the first electronic counter, and the grand total count of the second electronic counter, should such even be possible as for purposes of fraud, will be completed because any attempted validation of such manipulation by the electronically-detectable readouts requires such electronic means for receiving these readouts, and such knowledge for interpreting them, as may not be available to the party performing the unauthorized and abnormal manipulation.

13. The device according to claim 12 wherein the electronic readout means comprises:

a light transmitter for producing the readouts as encoded beams of light;

wherein such encoded beams of light may suitably be received by an electronic scanner.

14. A system of improved security for keeping track of the money entered into a money-operated apparatus, the system comprising:

an electronic money counter for electronically maintaining a count of monies entered into the apparatus since a previous readout, and a grand total count of monies ever entered into the apparatus, the count and the grand total count of the electronic money counter being abnormally manipulatable as for purposes of fraud if at all only electronically;

an electronic anti-tamper sensor means for detecting any occurrence of electrical tampering to the electronic money counter; and an electronic readout means for producing readouts of the total from the first electronic counter, the grand total from the second electronic counter, and the occurrence of tampering from the anti-tamper sensor means, of the electronic money counter;

a transportable electronic sensor for receiving and storing the readouts, and for further controllably output such stored readouts when directed to do so; and a central computer, directing the transportable electronic sensor to output the stored readouts, and receiving the readouts so output, for displaying the readouts in a manner in which a human analyst may determine whether tampering has occurred and whether monies collected from the apparatus are in agreement with monies recorded as entered into the apparatus.

15. A tamper resistant coin-operated machine comprising:

a normally-closed coin-receiving electrical switch means for momentarily electrically opening upon the receipt of a coin, a coin tracker means, connected to and through the switch means upon a signal line, for generating a detectable electrical signal on the signal line, which signal is transmitted through the switch means when it is closed back to the coin tracker means as an input signal, for first detecting any prolonged absence of the detectable electrical signal on the signal line as an indication that the coin tracker means is itself abnormally electrically disconnected from the coin-receiving electrical switch means and/or that the coin-receiving electrical switch means is abnormally jammed electrically open, and for second detecting any momentary absence of the detectable electrical signal on the signal line as an indication that the coin-receiving electrical switch means has received a coin, the coin tracker means generating a coin-received output signal in the event of such a second detection; and a machine controller responsive to the coin-received signal received from the coin tracker means for enabling a machine function.

16. The tamper resistant coin-operated machine according to claim 15 wherein the coin tracker means further comprises:

coin counter means for counting the number of times that the coin-received electrical signal is received, and for logging such occurrences in order to maintain a current coin-count representing the total number of coins received into the coin-receiving electrical switch means;

17. The tamper resistant coin-operated machine according to claim 15 wherein the coin tracker means further comprises:

power outage detection means for third detecting any outages of power to the coin tracker means due to power down or power disconnection, and for logging any such power outages.

18. The tamper resistant coin-operated machine according to claim 17 wherein the coin tracker means further comprises:

coin counter means for counting the number of times that the coin-received electrical signal is received, and for logging such occurrences in order to maintain a current coin-count representing the total number of coins received into the coin-receiving electrical switch means; and reporting means responsive to external interrogation for communicating externally to the coin tracker means, and to the machine, both (i) the current coin-count and (ii) any second-detected abnormal electrical disconnects from the coin-receiving electrical switch, and (iii) any third-detected power outages;

wherein any excessive number of reported abnormal electrical disconnects and/or power outages may mean that the coin tracker module, and/or the machine, is being subject to unauthorized manipulation.

19. The tamper resistant coin-operated machine according to claim 15 wherein the coin tracker means further comprises:

coin counter means for counting as a current coin count the number the number of times the coin-received output signal is generated; and reporting means responsive to external interrogation for communicating externally to the coin tracker means, and to the machine, both (i) the current coin-count and (ii) any first-detected abnormal electrical disconnect from the coin-receiving electrical switch means.

20. The tamper resistant coin-operated machine according to claim 15 wherein electrical disconnection of the coin tracker means from the machine makes generation of the coin-received signal impossible, and thus disables the machine controller from enabling the machine function.

21. The tamper resistant coin-operated machine according to claim 15 wherein the coin tracker means further comprises:

means for monitoring, as well as generating, the coin-received output signal from the coin tracker means to the machine controller;

wherein the coin tracker means not only drives the coin-received signal, but monitors itself the results of its signal drive;

wherein if the detectable electrical signal corresponding to the one generated by the coin tracker means is detected on the output signal then an untoward occurrence, namely the jumpering of an input of the coin tracker means to an output of the coin tracker means, has occurred.

22. The tamper resistant coin-operated machine according to claim 15 wherein, in the event that a jumpering of the inputs to the outputs of the coin tracker means has been detected, the coin-received output signal to the machine controller is subsequently disabled, even should the jumpered condition thereafter be abated.

23. A tamper resistant coin-operated machine comprising:

a coin-receiving electrical switch means for momentarily electrically changing continuity upon the receipt of a coin, the coin-receiving electrical switch means wired so as to be normally closed;

a coin tracker means, connected to and through the switch means, for detecting any momentary change in electrical continuity of the switch means as an indication that the switch means has received a coin, for generating a coin-received output signal in the event of such a detection, for monitoring, as well as generating, the coin-received output signal, and for disabling further generating of the coin-received output signal in the event that the monitoring detects anything abnormal in the coin-received output signal, wherein the coin tracker means not only generates the coin-received signal, but monitors itself the results of its signal generation, the coin tracker means comprising means for generating a detectable electrical signal on the signal line, which signal is transmitted through the coin-receiving electrical switch means, when the coin-receiving electrical switch means is closed, back to the coin tracker means as an input signal, means for first detecting any prolonged absence of the detectable electrical signal on the signal line as an indication that the coin tracker means is itself abnormally electrically disconnected from the coin-receiving electrical switch means and/or that the coin-receiving electrical switch means is abnormally jammed electrically open, and means for second detecting any momentary absence of the detectable electrical signal on the signal line as an indication that the coin-receiving electrical switch means has received a coin, the coin tracker means proceeding to generate a coin-received output signal in the event of such a second detection;

wherein the communication by the coin tracker of the detectable electrical signal on the switch signal line through the normally-closed coin-receiving electrical switch means can transpire substantially continuously, save during any deposit of coins into the coin-receiving electrical switch;

wherein the second-detecting by the coin tracker can transpire substantially continuously save during deposit of coins into the coin-receiving electrical switch means; and a machine controller responsive to the coin-received signal received from the coin tracker means for enabling a machine function;

wherein if any abnormality is monitored by the coin tracker means on its coin-received output signal then an untoward occurrence has occurred and machine function is thereafter no longer enabled.

* * * * *